US006343193B1

(12) United States Patent
Matsumoto et al.

(10) Patent No.: US 6,343,193 B1
(45) **Date of Patent: *Jan. 29, 2002**

(54) PROCESS CARTRIDGE AND IMAGE FORMING APPARATUS INCLUDING A DEVELOPER REMAINING AMOUNT DETECTING MEMBER

(75) Inventors: Hideki Matsumoto, Susuno; Keiji Okano, Tokyo; Seiji Yamaguchi, Numazu, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/958,369

(22) Filed: Oct. 27, 1997

(30) Foreign Application Priority Data

Oct. 30, 1996 (JP) ..... 8-288022

(51) Int. Cl.[7] ..... G03G 15/00
(52) U.S. Cl. ..... 399/27; 399/25
(58) Field of Search ..... 399/9, 24, 25, 399/27, 29, 30, 111, 61, 10, 12, 13, 119

(56) References Cited

U.S. PATENT DOCUMENTS 4,771,313 A * 9/1988 Kuroda et al. ..... 399/25
4,873,549 A * 10/1989 Tada et al. ..... 399/25
4,961,088 A * 10/1990 Gilliland et al. ..... 399/25
5,105,219 A 4/1992 Yoshikado
5,155,527 A * 10/1992 Gokita et al. ..... 399/29
5,283,613 A 2/1994 Midgley, Sr.
5,572,292 A * 11/1996 Chatani et al. ..... 399/25
5,708,912 A * 1/1998 Lee ..... 399/24
5,812,902 A * 9/1998 Lee ..... 399/25
5,835,817 A * 11/1998 Bullock et al. ..... 399/25

FOREIGN PATENT DOCUMENTS

EP 0 514 874 11/1992
EP 0 699 978 A2 3/1996

OTHER PUBLICATIONS

Patent Abstract of Japan, vol. 97, No. 001, Jan. 31, 1997 (JP–08–234555).
Patent Abstract of Japan, vol. 96, No. 009, Sep. 30, 1996 (JP–08–137237).
Patent Abstract of Japan, vol. 14, No. 264, Jun. 7, 1990 (JP 02–072381).
Patent Abstract of Japan, vol. 13, No. 004, Jan. 9, 1989 (JP 63–212956).

* cited by examiner

*Primary Examiner*—Sandra Brase
(74) *Attorney, Agent, or Firm*—Fitzpatrick, Cella, Harper & Scinto

(57) ABSTRACT

A process cartridge includes an electrophotographic photosensitive member, a developer for developing a latent image formed on the electrophotographic photosensitive member, a developer remaining amount detecting member for detecting a remaining amount of developer in the developer, and a non-volatile memory for memorizing information corresponding to at least the print number of sheets and the developer remaining amount in such a manner that such information can be read out and re-written by an image forming apparatus. The present invention also provides and electrophotographic image forming apparatus to which such a process cartridge can be detachably mounted.

46 Claims, 8 Drawing Sheets

PROCESS CARTRIDGE AND IMAGE FORMING APPARATUS INCLUDING A DEVELOPER REMAINING AMOUNT DETECTING MEMBER

BACKGROUND OF THE INVENTION

1. Field of the Invention

The present invention relates to an electrophotographic image forming apparatus such as a copying machine, a page printer and the like, and more particularly it relates to an electrophotographic image forming apparatus having an improved process cartridge portion.

2. Related Background Art

In conventional electrophotographic image forming apparatuses using electrophotographic image forming process, a process cartridge, in which an electrophotographic photosensitive member and process means acting on the electrophotographic photosensitive member are integrally assembled as a cartridge unit, which can detachably mounted to a main body of an image forming apparatus, has been used. By using such a process cartridge, since the user himself can perform the maintenance of the apparatus without the help of any expert, operability is greatly improved. Thus, the process cartridge has widely been used in electrophotographic image forming apparatuses.

In an electrophotographic image forming apparatus using the process cartridge, since the user himself must exchange the process cartridges, a means must be provided for informing the user of the exchanging time for the process cartridge. To this end, in the past, a remaining amount of toner in the process cartridge was detected in the following manners to inform the user of the exchanging time for the process cartridge.

(1) A conductive antenna is disposed in the vicinity of a developing sleeve, and a remaining amount of toner is judged on the basis of the electrostatic capacity between the antenna and the sleeve (i.e., the dielectric constant of toner is utilized).

(2) A laser light emitting element and a light receiving element are provided, and a remaining amount of toner is judged on the basis of the fact that the light emitted from the light emitting element is not received by the light receiving element if there is any toner between these elements (i.e., the light shielding ability of toner is utilized).

(3) A remaining amount of toner is judged on the basis of a weight of a toner container (i.e., the weight of toner is utilized).

(4) The number of copies from the initiation of copying is stored by using a re-writable memory means. Or, (5) The total light emitting time of a laser is stored by using a re-writable memory means.

SUMMARY OF THE INVENTION

A first object of the present invention is to provide a process cartridge and an electrophotographic image forming apparatus to which such a process cartridge can be mounted, which can further improve the above-mentioned conventional techniques and which can always detect a remaining amount of toner correctly to inform the user of the present printable number of sheets.

A second object of the present invention is to provide a process cartridge and an electrophotographic image forming apparatus to which such a process cartridge can be mounted, which can always detect the remaining amount of toner correctly regardless of the kind of a process cartridge to be used.

A third object of the present invention is to provide a process cartridge and an electrophotographic image forming apparatus to which such a process cartridge can be mounted, which can always detect the remaining amount of toner more correctly to inform the user of the remaining usable days of toner.

A fourth object of the present invention is to provide an electrophotographic image forming apparatus which can always detect a remained amount of toner more correctly by using a plurality of detection means for detecting the remaining amount of toner.

DETAILED DESCRIPTION OF THE PREFERRED EMBODIMENTS (First Embodiment)

Figure 1:
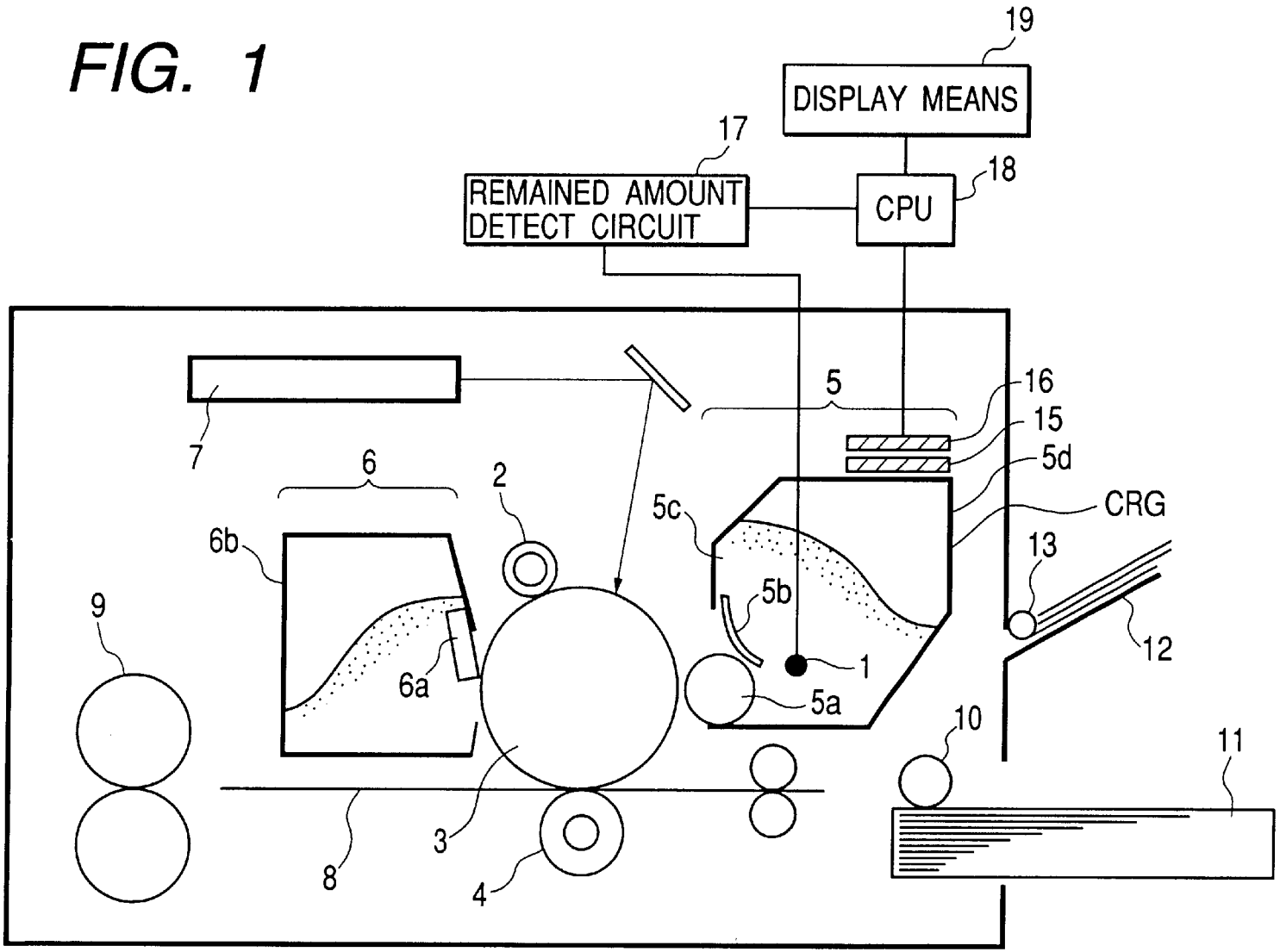
FIG. 1 is a sectional view of an image forming apparatus according to a first embodiment of the present invention.

First of all, the entire construction of an electrophotographic image forming apparatus will be explained with reference to FIG. 1. The image forming apparatus includes an electrophotographic photosensitive drum (latent image bearing member) 3, a charge device 2 for uniformly charging the photosensitive drum 3, an exposure device 7 for forming an electrostatic latent image on the photosensitive drum 3 by using laser light, and a developing device 5 for visualizing the electrostatic latent image formed on the photosensitive drum 3 as a visualized image, which developing device has a developing sleeve (developer bearing member) 5*a*, a developer regulating member 5*b* and a hopper 5*d* for storing toner (developer) 5*c*. The image forming apparatus further includes a transfer device 4 for transferring the visualized image formed on the photosensitive drum 3 onto a transfer sheet 8, a fixing device 9 for fixing the visualized image transferred to the transfer sheet 8 onto the transfer sheet, and a cleaning device 6 for removing the toner 5*c* remaining on the photosensitive drum 3 (not transferred to the transfer sheet 8), which cleaning device has a cleaning blade 6*a* urged against the photosensitive drum 3 and a waste toner container 6*b*.

The photosensitive drum 3, the charge device (charge roller) 2, the developing device 5 and the cleaning device 6 are integrally assembled as a cartridge unit (process cartridge CRG) which can easily be replaced by a new one, for example, when the toner stored in the hopper 5*d* is used up.

In the illustrated embodiment, a non-volatile memory 15 is provided on the process cartridge so that reading/writing of the memory 15 can be effected from the side of the main body of the electrophotographic image forming apparatus outside of the process cartridge. The information of the process cartridge itself, regardless of the electrophotographic image forming apparatus, is stored in the memory, but, the reading/writing is permitted only when the process cartridge is mounted on the main body of the electrophotographic image forming apparatus and the memory 15 of the process cartridge is connected to a connector 16 of the main body of the electrophotographic image forming apparatus.

The illustrated embodiment is characterized in that both a means for detecting the remaining amount of toner and the non-volatile memory are provided on the cartridge CRG. Prior to a detailed explanation of the illustrated embodiment, (1) the method and means for detecting the remaining amount of toner and (2) the non-volatile memory and its role will be explained.

[(1) Method and Means for Detecting Remained Amount of Toner]

(1-1) Means for Detecting Remaining Amount of Toner

As the means for detecting the remaining amount of toner, any conventional arrangement can be used so long as information regarding the remaining amount of toner can fundamentally be detected. More specifically, an arrangement of the capacity-detecting type, an arrangement using a magnetic sensor, an arrangement for detecting the weight of toner or an arrangement of the light permeable type can be used. In the illustrated embodiment, the means for detecting the remaining amount of toner is constituted by an antenna electrode (remaining amount detecting member) for detecting the electrostatic capacity and a remaining amount detecting circuit for the remaining amount on the basis of the detected electrostatic capacity.

(1-2) Method for Detecting Remaining Amount of Toner

Next, a method for detecting the remaining amount of toner using an antenna for detecting the electrostatic capacity will be described with reference to FIG. 4.

Figure 4:
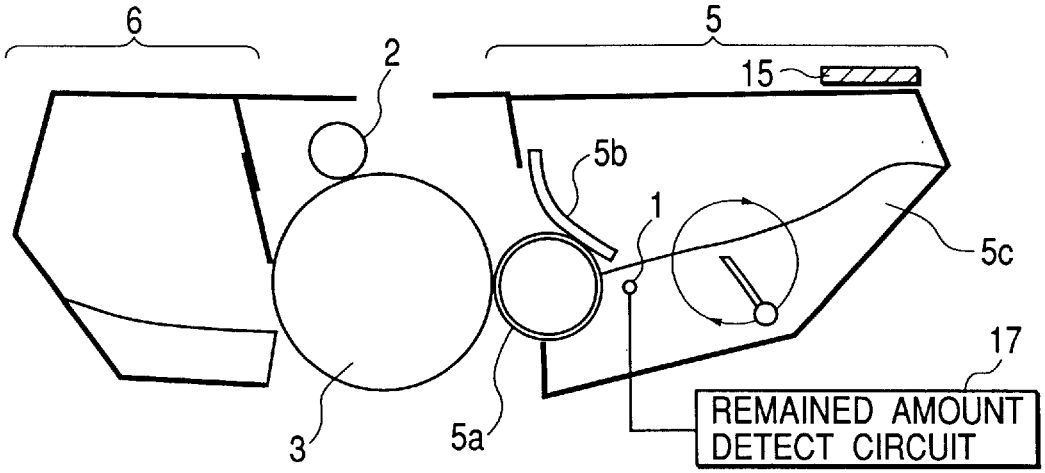
FIG. 4 is a sectional view showing a process cartridge.

In FIG. 4 which is a sectional view of the cartridge, which is detachably mountable to the main body of the electrophotographic image forming apparatus, an antenna electrode 1 is horizontally disposed within the developing device 5, and is connected to a remaining toner amount detecting circuit 17 of the main body of the electrophotographic image forming apparatus when the cartridge is mounted to the electrophotographic image forming apparatus. In the remaining toner amount detecting circuit 17, the remaining amount of toner is detected by reading the capacitance between the antenna electrode and the developer (toner) bearing member. That is to say, the detected capacitance between the antenna 1 and the developing sleeve 5*a* is varied with the amount of toner therebetween.

(1-3) Position of Antenna Electrode

Figure 5:
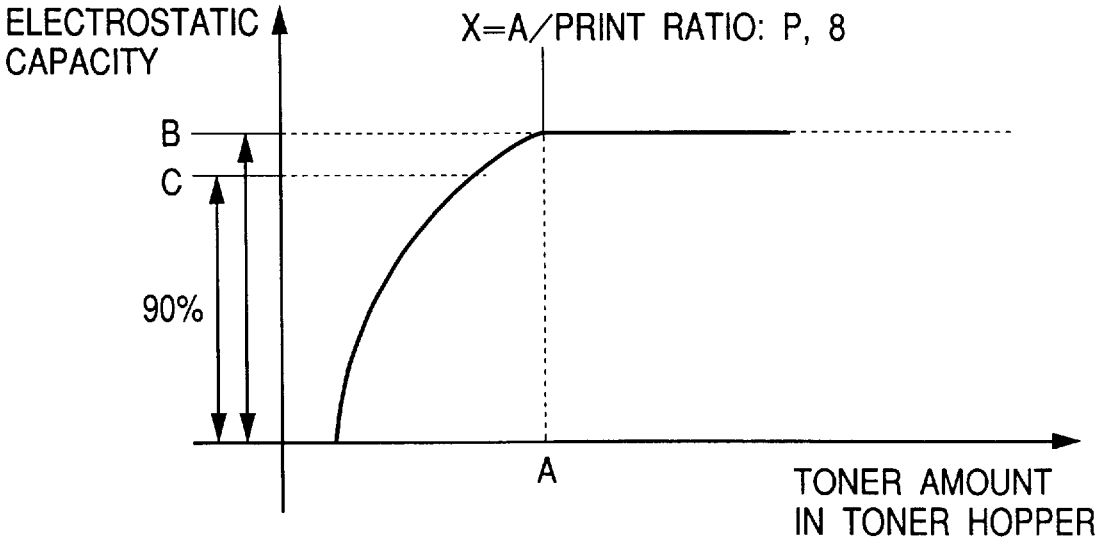
FIG. 5 is a graph showing the relation between a toner amount and electrostatic capacity.

In FIG. 5, which is a graph showing the relation between the amount of toner in the developing device and the detected electrostatic capacity, the electrostatic capacity does not substantially change until the toner is decreased to a certain amount and thereafter is changed greatly. If the greater the distance between the antenna electrode and the developing sleeve, the greater the noise and if the antenna is disposed in the vicinity of the developing sleeve, the electrostatic capacity does not change until immediately before the toner is used up. Thus, the proper position of the antenna electrode must be selected.

[(2) Non-volatile Memory and its Role]

(2-1) Non-volatile Memory

As the non-volatile memory, any memory can be used so long as signal information can be stored in a re-writable manner. For example, a RAM, an electrical re-writable memory means such as a ROM, or a magnetic memory means such as a magnetic memory medium, a magnetic bubble memory or photo-magnetic memory can be used. In the illustrated embodiment, NV-RAM (Non-Volatile Random Access Memory) is used.

(2-2) Role of Non-volatile Memory

In the illustrated embodiment, each cartridge is provided with the NV-RAM. With this arrangement, for example, even when several cartridges CRG are used in association with a single electrophotographic image forming apparatus (i.e., when a color image is formed) or even when a single cartridge CRG is used in association with a plurality of electrophotographic image forming apparatuses, the remaining amount of toner in each cartridge can be detected without any problem.

In the illustrated embodiment, the following three information data are stored in the memory.

(i) A predetermined number of printed sheets based upon past electrostatic capacity detection and the cartridge's electrostatic capacity;

(ii) The present number of printed sheets; and (iii) The present printable number of sheets.

Now, the above three data will be explained.

[Predetermined number of printed sheets based upon past electrostatic capacity detection and the cartridge's electrostatic capacity]

In the illustrated embodiment, the electrostatic capacity is measured every predetermined number of sheets. The predetermined number is selected to be a multiple of hundred (100) in an initial condition in which a relatively large amount of toner remains (since there is substantially no change in electrostatic capacity) and to a multiple of ten (10) from when the remaining amount of toner is decreased below a predetermined value (value "A" in FIG. 5) to start the change in electrostatic capacity.

The electrostatic capacity is measured every predetermined number of sheets, and, among the measured values, only two sets of latest data are preserved in the following manner.

When the predetermined number is reached, a CPU reads in two sets of past data from the NV-RAM and performs a calculation (which will be described later) by using these two sets of data and the present data (three sets of data in total). Thereafter, the latest data is memorized in address a of the NV-RAM and previous data (data latest but one) is memorized in address b of the NV-RAM (information memorized in the address b before the data is read in is lost).

[Present number of printed sheets]

After the printing is finished, the CPU reads in the "present number of printed sheets" stored in the NV-RAM, and a value obtained by adding one to the read-in data is memorized in the NV-RAM so that the number of printed sheets regarding the cartridge itself is always memorized.

[Present printable number of sheets]

The display value of the electrophotographic image forming apparatus is associated with the present printable number of sheets.

Initial condition (Up to the value A in FIG. 5):

The present printable number of sheets when the toner is decreased to the value A in FIG. 5 is calculated on the basis of the remaining amount of toner when the change in electrostatic capacity is started (value A in FIG. 5) and the general average print ratio, and the calculated value is memorized (in the illustrated embodiment, this value is referred to as "X" hereinafter). This value is not re-written until the remaining amount of toner reaches the value A in FIG. 5.

From when the change in electrostatic capacity is started (After the value A in FIG. 5):

(1) In a case where the present printable number of sheets was calculated (calculation is effected every ten printed sheets), the calculated present printable number of sheets is re-written and memorized (the calculating method will be described later).

(2) In a case where the present printable number of sheets is not, immediately, after the printing is finished, the CPU reads in the present printable number of sheets from the NV-RAM, and a value obtained by subtracting one from the present printable number is re-written and memorized in the NV-RAM.

In the illustrated embodiment, in order to increase the process speed by decreasing the access number between the cartridge and the main body of the image forming apparatus, the value of the comparative printable number of sheets is stored in a memory of the CPU of the electrophotographic image forming apparatus (it is not necessary that a memory of this CPU is a non-volatile memory). The re-writing of this value will be described later.

Figure 2:
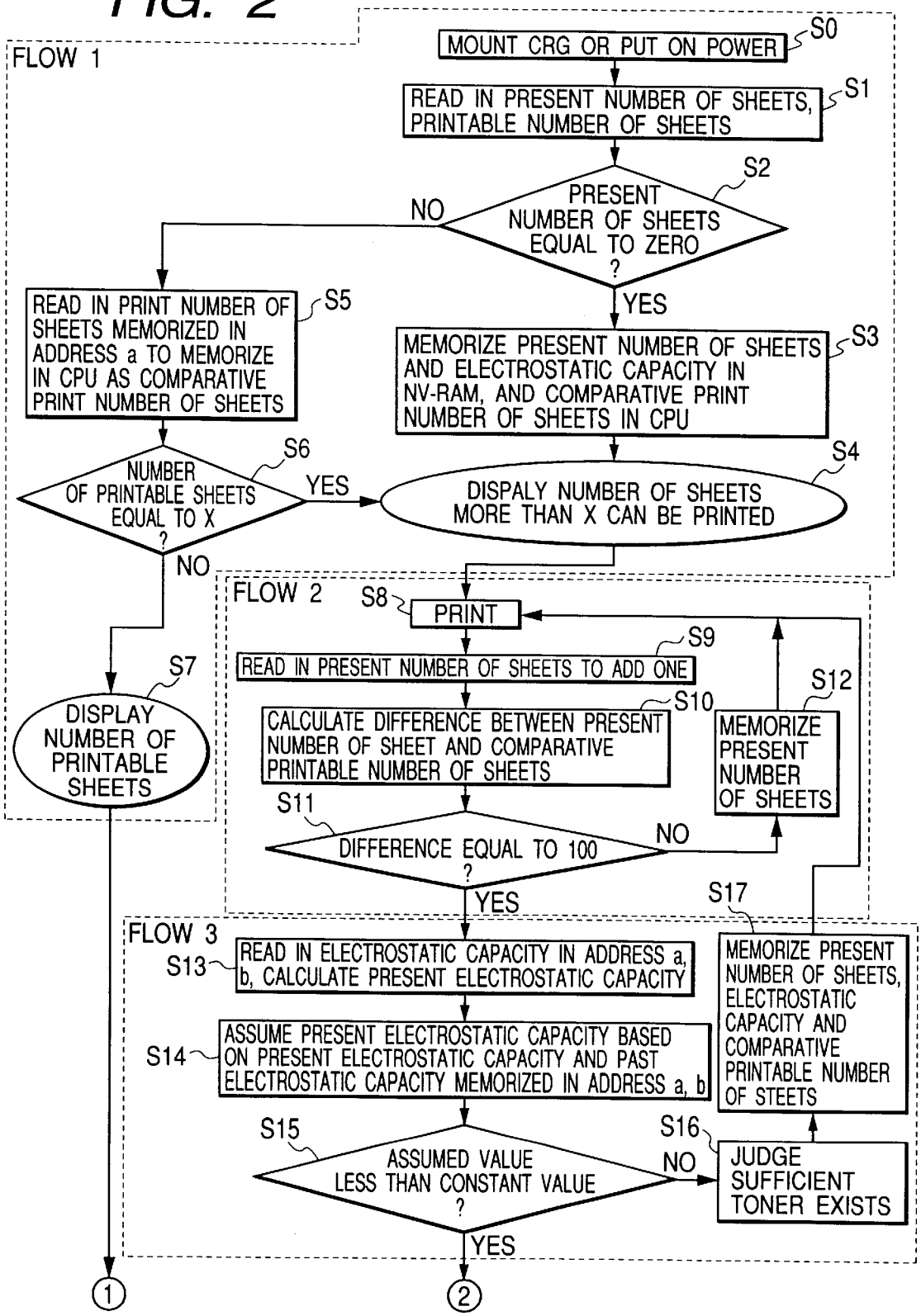
FIGS. 2 and 3 are flow charts for calculating the present printable number of sheets of the image forming apparatus according to the present invention.
Figure 3:
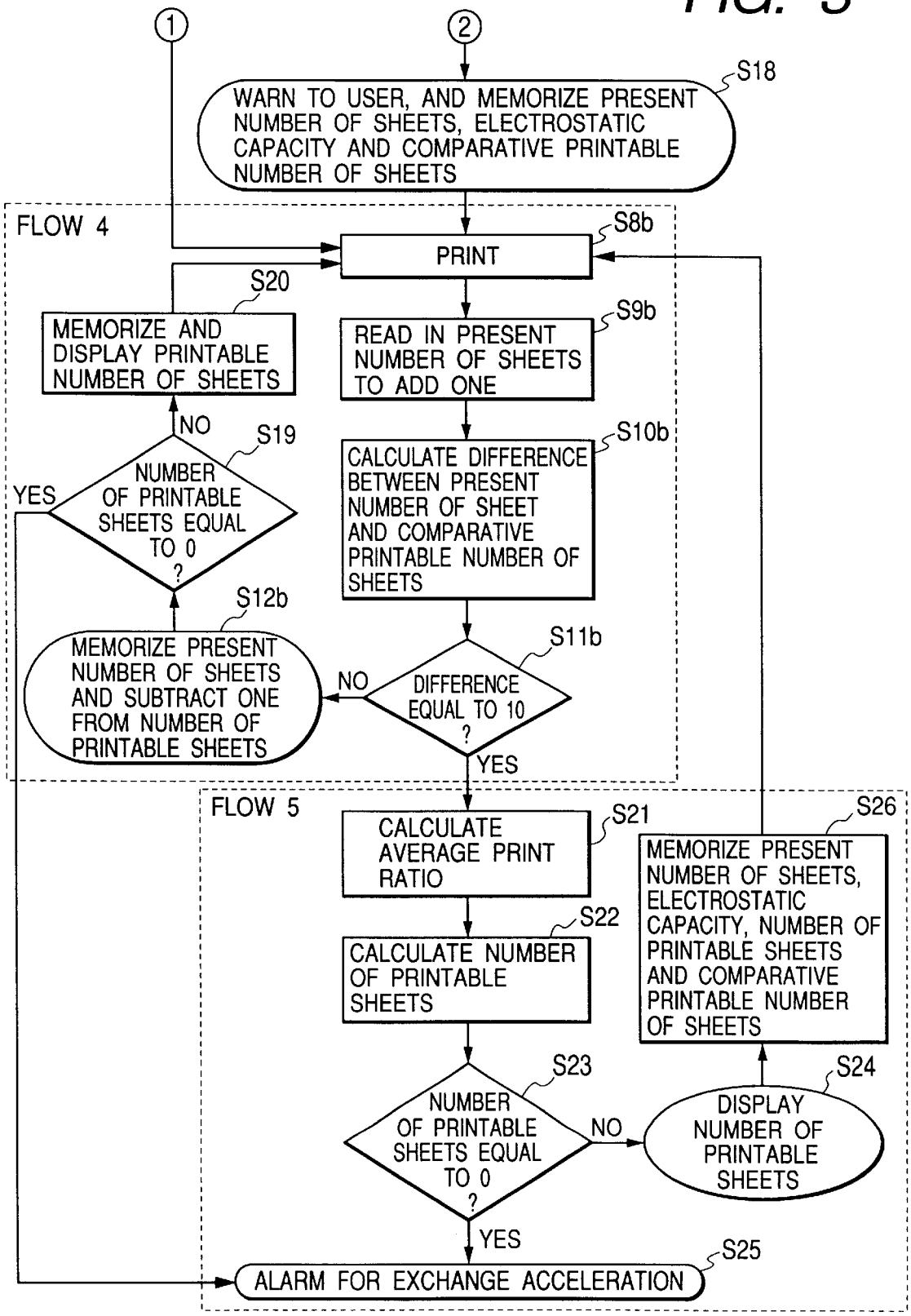

On the basis of the above explanation, the operation of the illustrated embodiment will now be described with reference to a flow chart shown in FIG. 2.

Flow 1 (flow for preparation for printing):

Step S0: the cartridge is mounted to the main body of the image forming apparatus or the power source is turned ON. Steps S1 and S2: the present number of sheets and the present printable number of sheets stored in the NV-RAM of the cartridge are read in. If the present number of sheets is zero (0), the program goes to a step S3; otherwise, the program goes to a step S5.

Steps S3 and S4: the present number of sheets and the electrostatic capacity are memorized in the NV-RAM and the comparative print number of sheets is memorized in the memory of the CPU, and the fact that the number of sheets more than X can be printed is displayed. Step S5: the print number of sheets memorized in the address a of the NV-RAM (number memorized at the latest) is read in and this value is memorized in the CPU as the comparative print number of sheets.

Step S6: if the present printable number of sheets is X, the program goes to the step S4; otherwise, the program goes to a step S7. Step S7: the present printable number of sheets is displayed.

Flow 2 (flow during the printing):

A step S8: the printing is effected. Steps S9 and S10: the present number of sheets is read in from the NV-RAM, and the difference between the value obtained by adding one to the read number and the comparative print number of sheets is calculated.

Step S11: if the difference is 100, the program goes to a flow 3 (steps S13 to S17); otherwise, the program goes to a step S12.

Flow 3 (flow ascertaining whether the electrostatic capacity is decreased to a predetermined amount)

Step S13: values regarding the electrostatic capacity memorized in the addresses a, b of the NV-RAM are read in and the present electrostatic capacity is calculated. Step S14: the present electrostatic capacity is assumed on the basis of the present electrostatic capacity and past electrostatic capacity memorized in the addresses a, b.

Steps S15, S16 and S17: if the assumed value is greater than a constant value, it is judged that sufficient toner exists, and the present number of sheets and the electrostatic capacity are memorized in the NV-RAM (the latest data is memorized in the address a and the data latest but one is memorized in the address b) and the comparative print number of sheets is memorized in the CPU, and a waiting condition is maintained for the print in the step S8. If the assumed value is smaller than the constant value, the program goes to a step S18.

Step S18: the initiation of reduction of toner is warned to the user, and the present number of sheets and the electrostatic capacity are memorized in the NV-RAM (the latest data is memorized in the address a and the data latest but one is memorized in the address b) and the comparative print number of sheets is memorized in the CPU, and a waiting condition is maintained for the print in the step S8.

Flow 4 (during the normal printing after the toner is decreased from the constant value)

Step **S8*b*: printing is effected. Steps S9*b* and S10*b***: the present number of sheets is read in from the NV-RAM, and the difference between the value obtained by adding one to the read number and the comparative print number of sheets stored in the CPU is calculated.

Step **S11*b*: if the difference is 10, the program goes to a flow 5 (steps S21–S26); otherwise, the present number of sheets is memorized, one is subtracted from the present printable number of sheets, and the program goes to a step S19. Step S19: if the present printable number of sheets is zero (0), the program goes to a step S25; otherwise, the present printable number of sheets is memorized, the display is effected and the program goes to the print waiting condition in step S8*b***.

Flow 5 (flow for calculating the present printable number of sheets)

Steps S21 and S22: the average print ratio and the present printable number of sheets are calculated in manners which will be described later. Step S23: if the present printable number of sheets is zero (0), the program goes to a step S25; otherwise, the program goes to a step S24.

Steps S24 and S26: the present printable number of sheets is displayed, and the present print number of sheets, the electrostatic capacity and the present printable number of sheets are memorized in the NV-RAM and the comparative printable number of sheets is memorized in the CPU, and then the program goes to the print waiting condition in step **S8*b*. Step S25**: the exchange acceleration is alarmed to the user.

Next, the method for assuming the electrostatic capacity, the method for converting the assumed value into the toner amount, the method for seeking the past average toner use ratio and method for seeking the present printable number of sheets will be explained.

[Method for assuming electrostatic capacity and method for converting assumed value into toner amount]

Now, the method for converting the electrostatic capacity into the toner amount will be described.

(1) The maker previously seeks an ideal relation between the toner amount and the electrostatic capacity, and such a relation is previously inputted in the ROM of the image forming apparatus (when the relation can be considered to closely resemble a certain function, such a function is memorized, and, when the relation cannot be considered to closely resemble to a certain function, discrete data are memorized in the ROM of the image forming apparatus).

(2) When the electrostatic capacity is detected, the relation between the detected electrostatic capacity value and two past electrostatic values at a predetermined number (of sheets) (three values in total) resembles a straight line by using the method of least squares, thereby assuming the present electrostatic capacity.

By using this method, a possible inadvertent error can be reduced.

(3) The assumed value of the electrostatic capacity obtained in the above item (2) is applied to the above-mentioned ideal relation between the toner amount and the electrostatic capacity, thereby seeking the present toner amount corresponding to the assumed value.

[Method for seeking past average toner use a ratio and method for seeking the present printable number of sheets]

(1) On the basis of the present toner amount sought by the above method, the toner amount used up to now is calculated by using the following equation:

(toner amount used up to now)=(initial toner amount)−(present toner amount)

(2) On the basis of the present print number of sheets and the toner amount used up to now, the past average toner use ratio is calculated by using the following equation:

(past average toner use ratio)=(toner amount used up to now)/(present print number of sheets)

(3) On the basis of the present toner amount and the past average toner use ratio, the present printable number of sheets is calculated by using the following equation:

(present printable number of sheets)=(present toner amount)/(past average toner use ratio).

[Measuring interval]

Although the measuring interval between the measurements of the electrostatic capacity is not defined clearly, the smaller the measuring interval, the more correct detection of the remaining amount of toner. However, if the measuring interval is too small, since a large number of errors are picked up, there is a danger of obtaining a value different from the actual value. Thus, selection of an appropriate measuring interval is required.

[Detecting method]

In the illustrated embodiment, the relation between three latest data regarding the print number of sheets and the electrostatic capacity resembles to a straight line by using the method of least squares, thereby assuming the present electrostatic capacity value. On the basis of the values, the fact that the reduction of the toner amount from the constant value is started can be detected. However, the detection can be effected by judging whether the present electrostatic capacity exceeds the constant value. In this case, there is the advantage the contents to be memorized in the memory can be reduced but there is the disadvantage that the result is apt to be influenced by error.

The fact that the reduction of the toner amount from the constant value is started can be detected in the following methods:

(1) The detection is effected by using the difference between the latest past electrostatic capacity and the present electrostatic capacity.

(2) The detection is effected by using the ratio of the number of sheets to the change in electrostatic capacity (the number of data to be used and memorized can be selected freely).

(3) Plural sets of the past predetermined number and electrostatic capacity are reserved, and the data is fitted to a relation between the remaining amount of toner and the electrostatic capacity obtained by the method of least squares, and the detection is effected by using the relation with a reduction of error (this method is effective when the memory has the adequate capacity).

As mentioned above, by providing the memory on each cartridge and by using the above-mentioned toner remained amount detecting mechanism, it is possible to detect the correct remained amount of toner and to display the present printable number of sheets for the user.

The electrophotographic image forming apparatus is not limited to the laser printer of inverse developing type shown in the illustrated embodiment, but may be embodied as general electrophotographic image forming apparatuses such as word processors, facsimiles or copying machine of normal developing type.

(Second Embodiment)

Next, a second embodiment of the present invention will be explained.

The second embodiment is characterized in that, as well as (1) the past predetermined print number of sheets and electrostatic capacity, (2) the present print number of sheets and (3) the present printable number of sheets, (4) the "date" is also memorized or stored in the memory means (such as NV-RAM) of the cartridge (data at initiation of use is memorized and is unchanged), so that the number of usable days of the cartridge can be calculated and displayed.

That is to say, the second embodiment is the same as the first embodiment from the view point of appearance, but is different from the first embodiment in that the information stored in the non-volatile memory is increased by one and the calculation and display contents effected in the electrophotographic image forming apparatus slightly differ from those in the first embodiment. Now, the "date" and a method for seeking the "number of usable day" of the cartridge (different from the first embodiment) will be explained.

[Date data]

The date data is transferred between the computer and the NV-RAM when the first sheet is printed after the cartridge is mounted on the image forming apparatus or after the power source is turned ON. In the illustrated embodiment, the date information inputted in the computer is used as the date data, but, the information included in the electrophotographic image forming apparatus may be used, or the data information may be included in the cartridge itself or the date data may be inputted by the user himself.

[Number of usable days of cartridge]

Figure 6:
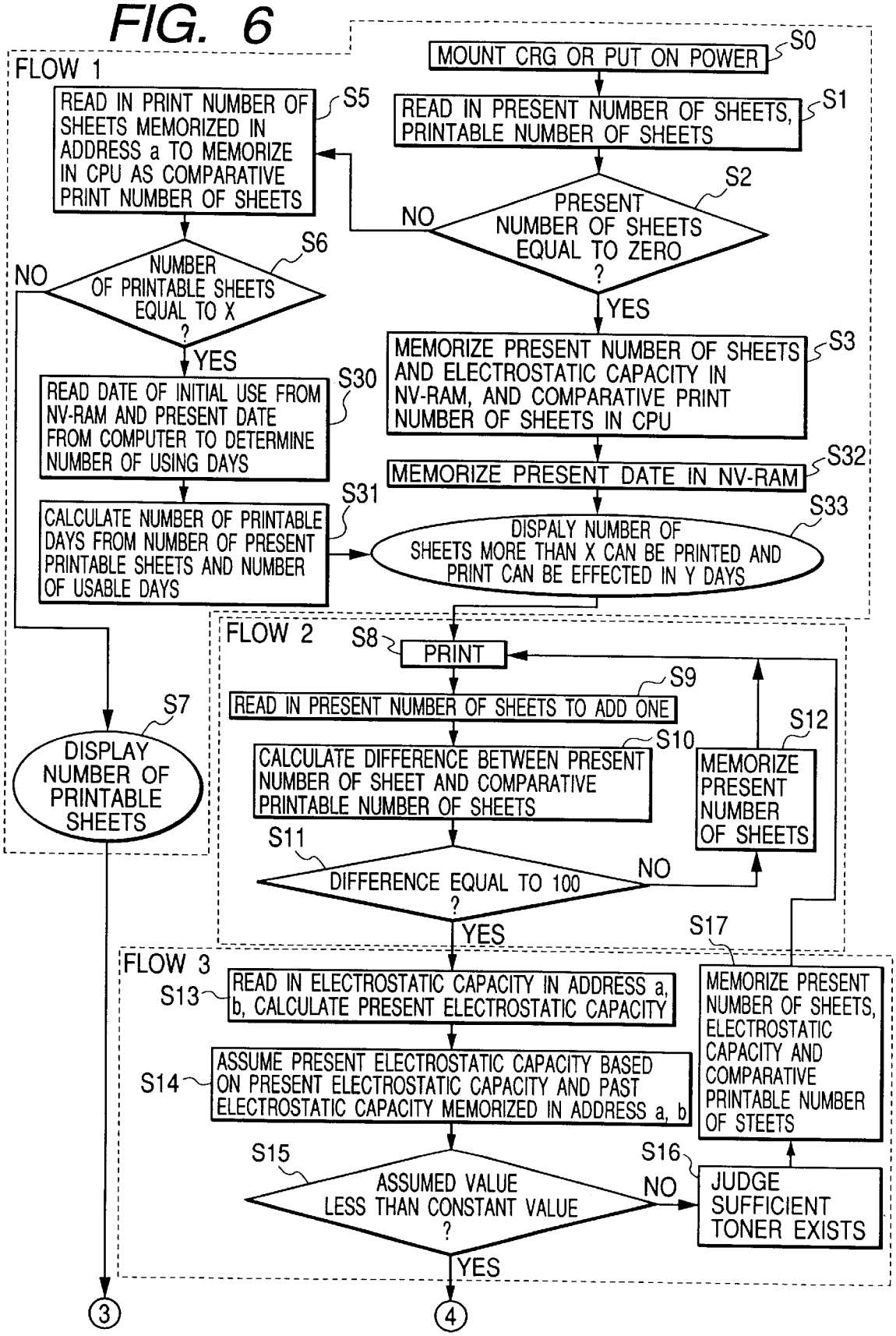
FIGS. 6 and 7 are flow charts for calculating the number of printable days of the image forming apparatus according to the present invention.
Figure 7:
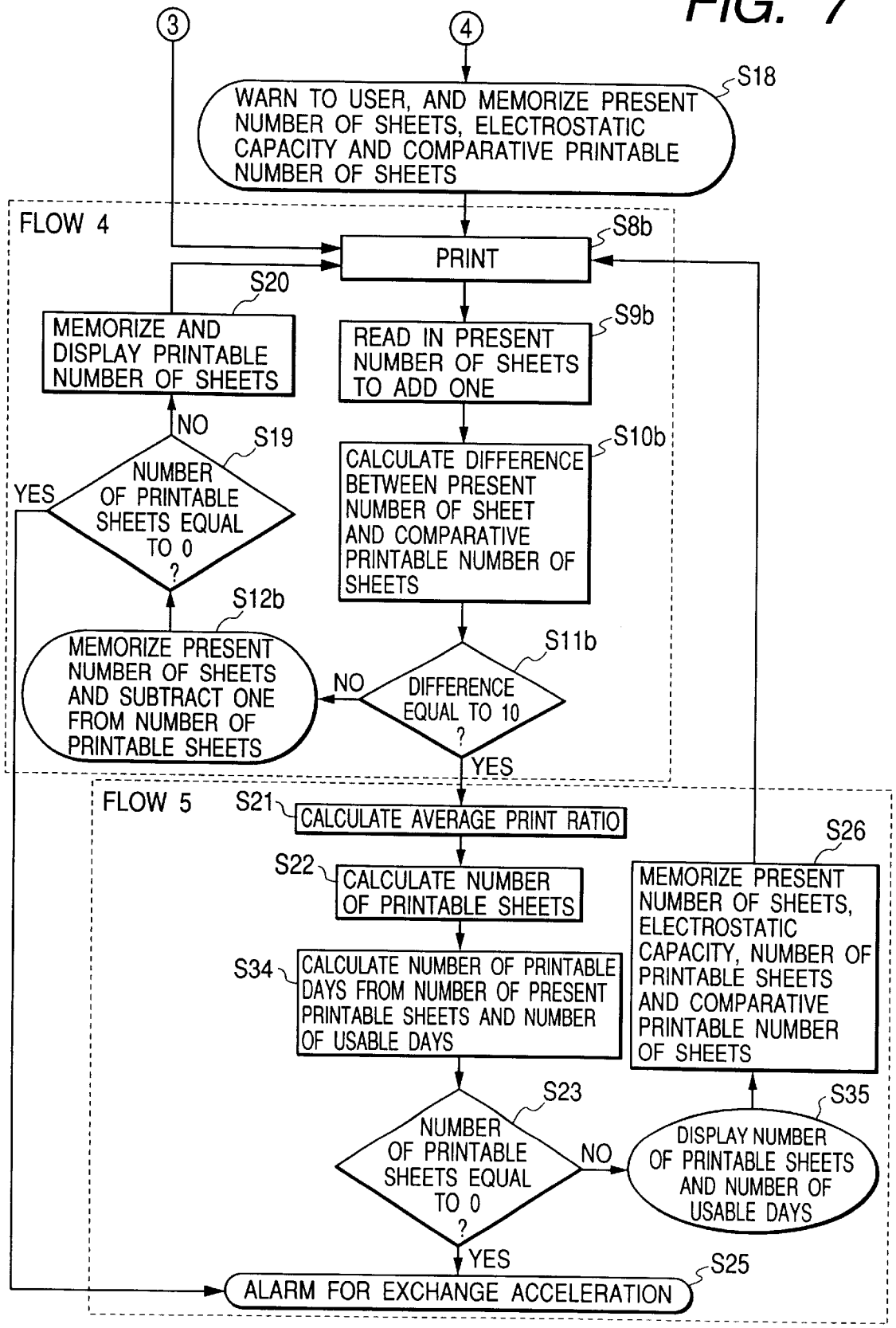

A method for seeking the number of usable days of the cartridge will be described with reference to a flow chart shown in FIGS. 6 and 7. (The flow chart shown in FIGS. 6 and 7 has steps similar to those in the first embodiment. Only the difference from the first embodiment will be explained.)

Step S30: the date when the printing is first effected is memorized in the memory of the cartridge (date is not re-written later). Steps S31 and S32: until the toner is decreased to the predetermined amount to start the change in the electrostatic capacity (up to the point A in FIG. 5), the number of usable days is calculated on the basis of the usable number of sheets (=(insurance number of sheets)−(present print number of sheets)) and the number of used days of the cartridge (function of present date and initial date). Step S33: in order to prevent an error, the number of usable days is not displayed until the 100 or more sheets are printed.

Step S34: the calculation of the number of usable days after the change in electrostatic capacity is started is effected in the following manner:

(1) The number of used days of the cartridge is sought, and, on the basis of the sought number and the present print number of sheets, the average print number of sheets per day is calculated by the following equation:

(average print number of sheets per day)=(present print number of sheets)/(number of used days)

(2) On the basis of the present printable number of sheets obtained in the same manner as the first embodiment and the average print number of sheets per day calculated in the above item (1), the number of usable days of the cartridge is calculated by the following equation:

(number of usable days of cartridge)=(present printable number of sheets)÷(average print number of sheets per day).

Incidentally, this calculation is fundamentally performed once a day (If the power source is turned ON twice or more a day or if the cartridge is mounted/dismounted twice or more a day, the calculation is performed twice or more).

When this method is used at the initial condition of the cartridge, since a great error may be caused, the display is not effected until 100 or more sheets are printed.

By using the above-mentioned method, the number of usable days of the cartridge, depending upon the frequency of use and/or usage condition of the user can, be calculated. Further, since the average use ratio of toner per day and the print number of sheets per each month were memorized (the print number of sheets per each month is calculated on the basis of the print number of sheets and the number of used days), when the cartridge is collected for re-cycling a, market survey can be performed on the basis of the information data of the collected cartridges.

Thus, the replacement dates of the cartridge can be judged, thereby improving usability. At the same time, the usage tendency of the cartridge in the market can be judged more correctly.

In the illustrated embodiment, although not fully explained due to the limitation of the capacity of the memory, calendar information (days of the week and holidays) may be set so that the number of usable days can be calculated more correctly by memorizing the past print numbers of sheets for each weekday and holiday.

(Third Embodiment)

Next, a third embodiment of the present invention will be explained.

As mentioned in connection with the first embodiment, regarding the detection of the toner remaining amount using the antenna, in the initial use condition of the cartridge, although the remaining amount of toner cannot be detected, when the toner is reduced below the predetermined amount, the remaining amount of toner can be detected correctly. On the other hand, regarding a total-laser-emitting time detecting method which will be described later, although the remaining amount of toner can generally be detected correctly in the initial use condition of the cartridge, error is accumulated as the print number of sheet is increased. In consideration of the above, the third embodiment of the present invention is characterized in that the printable number of sheets can be determined more correctly from the initiation of usage of the cartridge by combining the above two detection results with weighing.

Now, the total laser emitting time detecting method used in the third embodiment and the construction of the third embodiment will be explained.

[Total laser emitting time detecting method]

The total laser emitting time detecting method in this embodiment will be explained with FIG. 8.

Figure 8:
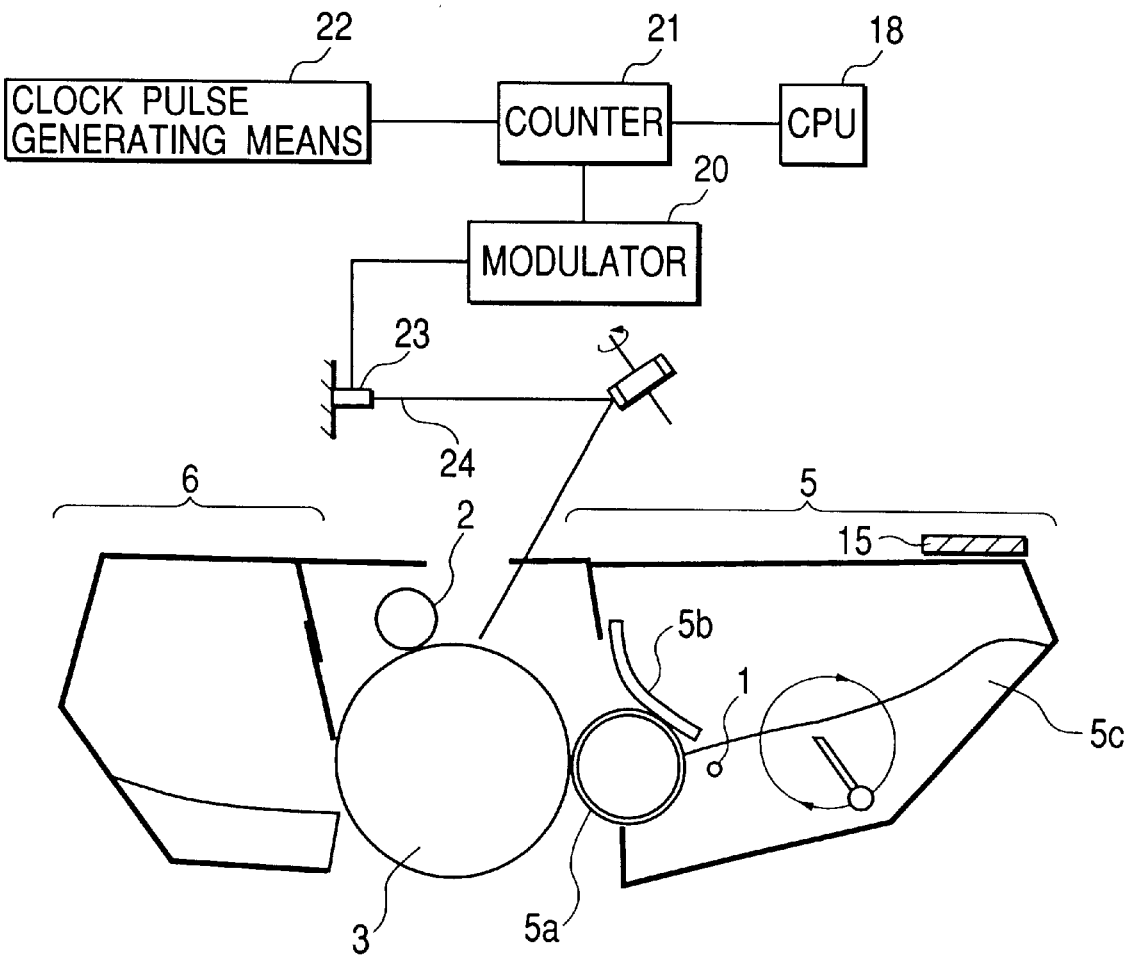
FIG. 8 is a view showing an arrangement for counting the laser light emitting time of an image forming apparatus according to another embodiment of the present invention.

In FIG. 8, a modulator 20 serves to modulate an image signal inputted from a computer into laser input voltage and to turn ON/OFF a laser 23 in correspondence to the image signal. The laser 23 is connected to the modulator 20 and adapted to emit laser light in response to the modulated signal. A counter 21 connected to the modulator 20 serves to measure time information corresponding to the output time from the modulator 20 to the laser 23, i.e., exposure time of a laser beam 24 emitted from the laser 23 onto the photosensitive drum 3. That is to say, a clock pulse generating means 22 such as a crystal oscillator is connected to the counter 21, and the counter 21 and the clock pulse generating means 22 constitute an adding means for counting the number of clock pulses during the duration of the laser emitting signal.

The remaining amount of toner is detected by assuming that the counted values is in proportion to the amount of used toner.

[Construction]

In this embodiment, as well as (1) the past predetermined print number of sheets and electrostatic capacity, (2) the present print number of sheets and (3) the present printable number of sheets, (4) "total laser emitting time count number" and (5) "weight" (from 0 to 1) are also memorized, and there is provided a sequence for effecting the total laser emitting time detection and a sequence for detecting the present remaining amount of toner by changing the weight. The other construction of the third embodiment is the same as the first embodiment.

Now, the different points (from the first embodiment) will be described.

[Present printable number of sheets]

The present printable number of sheets initially memorized in the memory is re-written whenever the sheet is printed, and the re-written values are displayed on the main body of the image forming apparatus.

[Total laser emitting time count number]

The total laser emitting time count number is added to the previous value read out from the NV-RAM whenever the sheet is printed, and the resultant value is re-written in the NV-RAM.

[Weight]

The weight means that, among the results of the total-laser-emitting-time detection and the antenna toner remained amount detection, the total laser emitting time detection result is weighted by the numeral value; namely, when 1 is weighted, only the total laser emitting time detection result is used, when 0.5 is weighted, both the total laser emitting time detection result and the antenna-toner-remained amount detection result are used by half, and, when 0 is weighted, the total-laser-emitting-time detection result is not used.

More specifically, the printable number of sheets are assumed by using the following equation:

$$(\text{assumed value of printable number of sheets})=aX1+(1-a)X2$$

where, a is the weight, X1 is the printable number of sheets obtained by the total laser emitting time detection and X2 is the printable number of sheets obtained by the antenna toner remained amount detection.

Figure 9:
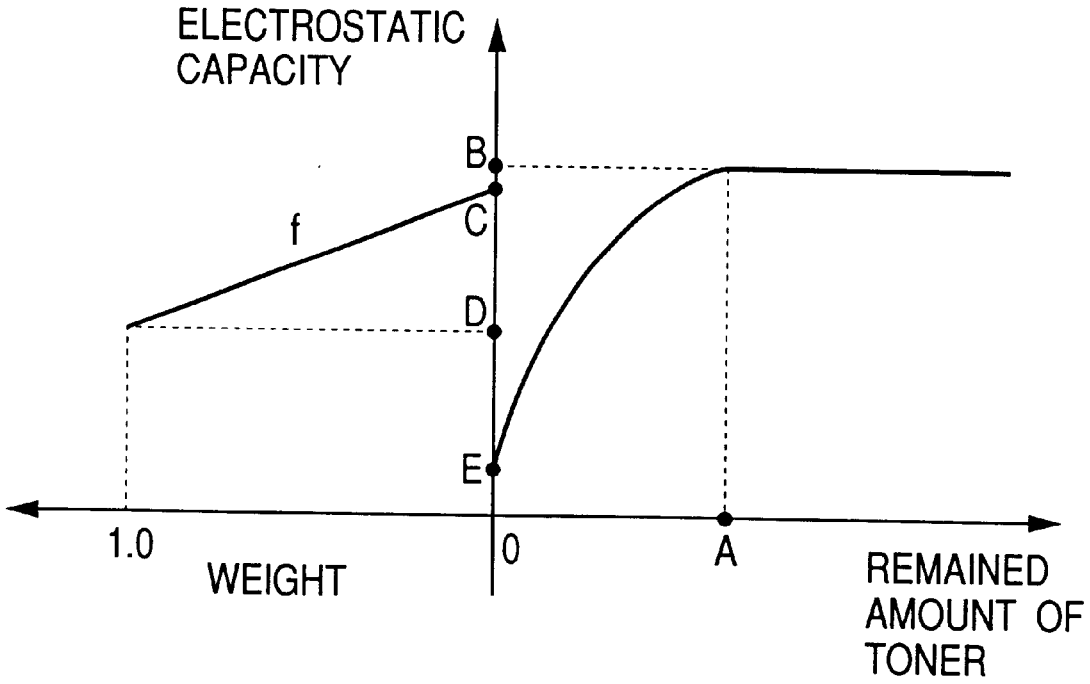
FIG. 9 is a graph showing the relation between a toner amount and electrostatic capacity, and weight and the electrostatic capacity.

FIG. 9 is a graph showing the relation between the remaining amount of toner and the electrostatic capacity and a relation between the weight and the electrostatic capacity.

In the illustrated embodiment, the relation between the electrostatic capacity and the weight is selected to become a straight line f in FIG. 9. In FIG. 9, a point C is a point dividing a line segment EB to 9:1 (i.e., line segment EC:line segment BC=9:1), and a point D is a point bisecting the line segment BE. Now, the toner remaining amount detecting method will be fully explained by using FIG. 9.

(1) Electrostatic capacity between B and C

Only the value sought by the total laser-emitting-time detection is used.

(2) Electrostatic capacity between C and D

On the basis of the weight a sought by the electrostatic capacity and the values X1, X2 sought from the antenna-toner-remaining amount detection and total laser emitting time detection equations, the remaining amount of toner is assumed by using the equation, i.e., $$(\text{assumed value of printable number of sheets})=aX1+(1-a)X2$$

(3) Electrostatic capacity between D and E

Only the value sought by the antenna toner remained amount detection is used.

Although the above-mentioned weight is used to prevent an abrupt change in the value of the printable number of sheets when the total laser emitting time detection is switched to the antenna toner remained amount detection, it is not necessary that the function of the weight shows the linear relation as shown in FIG. 9, but an appropriate function, such as higher order function or two-value function may be used.

On the basis of the above-mentioned explanation, the flow of this embodiment will be described.

The above-mentioned weight is determined by inputting the electrostatic capacity assumed by using the antenna-toner-remaining amount detection into the function of the weight stored in the image forming apparatus. After the weight is determined, in accordance with the determined value, the following two remaining amount detections are effected, and the printable number of sheets is calculated by using the assumed value of the toner remaining amount calculated by the respective detections and the weight and the above-mentioned equation.

[Antenna toner amount detection means]

When the weight=1:

Since the value of the antenna toner remained amount detection is not used, the calculation is not effected.

When the weight≠1:

The printable number of sheet is calculated in the manner described in connection with the first embodiment.

[Total laser emitting time detection means]

When 0<weight≦1:

The present printable number of sheets is calculated in the following manner whenever the sheet is printed.

(1) On the basis of the toner amount used up to now sought by the total laser emitting time and the present print number of sheets, the past average use ratio of toner is calculated by using the following equation:

$$(\text{past average use ratio of toner})=(\text{toner amount used up to now})\div(\text{present print number of sheets})$$

(2) On the basis of the present toner amount and the past average use ratio of toner, the present printable number of sheets is calculated by using the following equation:

$$(\text{present printable number of sheets})=(\text{present toner amount})/(\text{past average use ratio of toner}).$$

When the weight=0:

The detection is not effected.

As mentioned above, when the remaining amount of toner is detected by the combination of the total-laser emitting-time detection and the antenna-toner-remaining amount detection, it is possible to seek the present printable number of sheets from the initial condition of the cartridge.

In the illustrated embodiment, while an example that only the total laser emitting time detection is used as an auxiliary means until the electrostatic capacity can be detected was explained, another means, such as a sheet number detecting means, may be used or two or more kinds of toner remained amount detecting means may be used.

Incidentally, the process cartridge in the aforementioned embodiments may incorporate therein an electrophotographic photosensitive member, and a charge means, a developing means or a cleaning means as a cartridge unit which can detachably be mounted to the main body of the image forming apparatus, or may incorporate therein an electrophotographic photosensitive member, and at least one of a charge means, a developing means and a cleaning means as a cartridge unit which can detachably be mounted to the main body of the image forming apparatus, or may incorporate therein an electrophotographic photosensitive member and at least a developing means as a cartridge unit which can detachably be mounted to the main body of the image forming apparatus.

The electrophotographic image forming apparatus is of the type using an electrophotographic process and is capable of forming an image on a recording medium and may include an electrophotographic copying machine, an electrophotographic printer (laser printer, LED printer and the like) and an electrophotographic facsimile.

As mentioned above, according to the present invention, since the non-volatile memory means for memorizing the information regarding the print number of sheets and the remaining amount of toner is provided on the process cartridge and such information can be read out and re-written by the image forming apparatus, the correct present remained amount of toner of each cartridge can be detected and the image forming apparatus to which such a process cartridge can be mounted can be provided.

Further, since the image forming apparatus includes the means for counting the print number of sheets, means for storing the information regarding the relation between the toner remained amount and the electrostatic capacity, means for determining the present remained amount of toner on the basis of the relation between the toner remaining amount and the electrostatic capacity stored in the memory means and the detected value of the toner remaining amount detecting member, means for calculating the difference between the initial toner amount and the present toner amount and the average toner reduction ratio up to now (based on the present toner amount), and means for calculating the printable number of sheets on the basis of the present toner amount and the average toner reduction ratio, the user can easily know the present printable number of sheets.

Further, since the image forming apparatus includes the means for calculating the number of usable days on the basis of the present printable number of sheets and the past average print number of sheets, the user can know the number of usable days in the future.

In addition to the antenna as the detection member for detecting the toner remained amount, the second toner remaining amount detecting means is also provided so that, when the value of the electrostatic capacity measured by the antenna is constant, the toner remaining amount is detected only by using the value sought by the second toner remaining amount detecting means, and, from when the value of the electrostatic capacity measured by the antenna is changed, the toner remaining amount is detected only by using the value sought by the antenna. With this arrangement, the toner remaining amount in the initial condition of the cartridge (which is hard to be detected by the antenna) can be detected by the second toner remaining amount detecting means, and, from when the value of the electrostatic capacity is changed, the toner remaining amount can be detected by the antenna with high accuracy. By weighting the values obtained by the antenna and the second means, the detection value can smoothly be translated from one of two means to the other.

What is claimed is:

1. A process cartridge detachably mountable to a main body of an electrophotographic image forming apparatus, comprising:

an electrophotographic photosensitive member;

developing means for developing a latent image formed on said electrophotographic photosensitive member;

a developer remaining amount detecting member for detecting a remaining amount of developer in said developing means; and non-volatile memory means for memorizing information corresponding to at least the printed number of sheets and the developer remaining amount in such a manner that such information can be read out and re-written by said image forming apparatus.

2. A process cartridge according to claim 1, wherein the information regarding the print number of sheets includes data regarding the past predetermined print number of sheets, the present print number of sheets and the present printable number of sheets, and the information regarding the developer remaining amount includes data regarding the cartridge electrostatic capacity corresponding to said past predetermined print number of sheets.

3. A process cartridge according to claim 2, wherein said developer remaining amount detecting member is an antenna for detecting the cartridge electrostatic capacity corresponding to the developer remaining amount.

4. A process cartridge according to claim 3, wherein the information memorized in said non-volatile memory means also include date data.

5. A process cartridge according to claim 2, wherein the information memorized in said non-volatile memory means also include date data.

6. A process cartridge according to claim 1, wherein said developer remaining amount detecting member is an antenna for detecting the cartridge electrostatic capacity corresponding to the developer remaining amount.

7. A process cartridge according to claim 6, wherein the information memorized in said non-volatile memory means also include date data.

8. A process cartridge according to claim 1, wherein the information memorized in said non-volatile memory means also include data date.

9. An electrophotographic image forming apparatus including a process cartridge according to one of claims 1 to 4, and a main body to which said process cartridge can detachably be mounted to perform an image forming operation, comprising:

sheet print number counting means for counting the print number of sheets of transferring materials;

association information memory means for memorizing information regarding an ideal relation between the developer remaining and the cartridge electrostatic capacity;

remaining amount calculating means for calculating a present developer remaining amount on the basis of the relation between the developer remaining amount and the electrostatic capacity memorized in said association information memory means, and a detected value from said developer remaining amount detecting member;

reduction ratio calculating means for calculating an average reduction ratio of developer up to the present on the basis of the difference between an initial developer amount and the present developer remaining amount and the print number of sheets;

printable sheet number calculating means for calculating the printable number of sheets on the basis of the present developer remaining amount and the average reduction ratio of developer;

display means for displaying the print number of sheets; and means for reading out and re-writing the information of said non-volatile memory means disposed in said process cartridge.

10. An electrophotographic image forming apparatus according to claim 9, further comprising calculating means for calculating the number of usable days on the basis of the present printable number of sheets and the past average print number of sheets, and means for displaying the number of usable days.

11. An electrophotographic image forming apparatus according to claim 10, further comprising second developer remaining amount detecting means as well as an antenna as said developer remaining amount detecting member so that, when the value of the electrostatic capacity measured by said antenna is constant, the developer remaining amount is detected only by using a value detected by said second developer remaining amount detecting means, and, when the value of the electrostatic capacity measured by said antenna starts to change, the toner remaining amount is detected only by using the value measured by said antenna.

12. An electrophotographic image forming apparatus according to claim 9, further comprising second developer remaining amount detecting means as well as an antenna as said developer remaining amount detecting member so that, when the value of the electrostatic capacity measured by said antenna is constant, the developer remaining amount is detected only by using a value detected by said second developer remaining amount detecting means, and when the value of the electrostatic capacity measured by said antenna starts to change, the toner remaining amount is detected only by using the value measured by said antenna.

13. An electrophotographic image forming apparatus according to claim 12, wherein said second developer remaining amount detecting means is total laser emitting time detection means for detecting a total time of laser light emitted onto said electrophotographic photosensitive member.

14. An electrophotographic image forming apparatus according to one of claim 9, further comprising second developer remaining amount detecting means as well as an antenna as said developer remaining amount detecting member so that, when the value of the electrostatic capacity measured by said antenna is constant, the developer remaining amount is detected only by using the value detected by said second developer remaining amount detecting means, and, when the value of the electrostatic capacity measured by said antenna starts to change, the detected amount of said second developer remaining amount detecting means gradually approaches the detected value of said antenna without abrupt change by using a predetermined weight function.

15. A process cartridge according to one of claims 1 to 8, wherein the process cartridge incorporates therein said electrophotographic photosensitive member, and charge means, developing means or cleaning means as a cartridge unit which can detachably be mounted to the main body of said electrophotographic image forming apparatus.

16. A process cartridge according to one of claims 1 to 8, wherein the process cartridge incorporates therein said electrophotographic photosensitive member, and at least one of charge means, developing means and cleaning means as a cartridge unit which can detachably be mounted to said electrophotographic image forming apparatus.

17. A process cartridge according to one of claims 1 to 8, wherein the process cartridge incorporates therein said electrophotographic photosensitive member, and at least developing means as a cartridge unit which can detachably be mounted to said electrophotographic image forming apparatus.

18. An image forming apparatus comprising:

an image bearing member;

developing means for developing a latent image formed on said image bearing member;

developer amount detecting means for detecting an amount of developer in said developing means;

calculating means for calculating the number of printable sheets in accordance with the amount of developer detected by said developer amount detecting means and a developer use ratio; and output means for outputting information about the number of printable sheets calculated by said calculating means.

19. An image forming apparatus according to claim 18, wherein the developer use ratio is a number calculated by dividing an amount of used-up developer by the number of printed sheets printed with the aid of the used-up developer.

20. An image forming apparatus according to calim 18, wherein the number of printable sheets is a number calculated by dividing the amount of developer detected by said developer amount detecting means by the developer use ratio.

21. An image forming apparatus according to claim 18, further comprising a display for displaying the information, wherein said display displays the information output from said output means.

22. An image forming apparatus according to claim 18, wherein said calculating means calculates the number of printable sheets per a predetermined print number of sheets.

23. An image forming apparatus according to claim 22, wherein a calculating interval of the number of printable sheets when the amount of the developer is small is shorter than that when the amount of the developer is large.

24. An image my forming apparatus according to claim 22, wherein, when said apparatus effects printing on a sheet and said calculating means does not calculate the number of printable sheets, said calculating means reduces the number of printable sheets per one printing.

25. An image forming apparatus according to claim 18, wherein said output means outputs the same information until the amount of developer detected by said developer amount detecting means reaches a predetermined amount.

26. An image forming apparatus comprising:

a cartridge detachably mountable on a main assembly of said apparatus, said cartridge including at least a developer container for containing a developer;

calculating means for calculating the number of usable days of said cartridge in accordance with a present number of printable sheets and the number of printed sheets per day; and output means for outputting information about the number of usable days of said cartridge calculated by said calculating means.

27. An image forming apparatus according to claim 26, wherein the present number of printable sheets is a number calculated by dividing the remaining amount of the developer in said developer container by a developer use ratio.

28. An image forming apparatus according to claim 26, wherein the number of printed sheets per day is a number calculated by dividing the number of printed sheets by the number of used days of said cartridge.

29. An image forming apparatus according to claim 26, further comprising a display for displaying the information, wherein said display displays the information output from said output means.

30. A cartridge detachably mountable on an image forming apparatus, comprising:

a developer container for containing a developer; and a memory wherein said memory stores the number of printed sheets and the number of printable sheets.

31. A cartridge according to claim 30, wherein said memory further stores a starting date of use.

32. A cartridge according to claim 30, further comprising an image bearing member.

33. A cartridge according to claim 32, further comprising charging means for charging said image bearing member.

34. A cartridge according to claim 33, further comprising cleaning means for cleaning said image bearing member.

35. A cartridge detachably mountable on an image forming apparatus, comprising:

a developer container for containing a developer; and a memory, wherein said memory stores the number of printed sheets per day of the week.

36. A cartridge according to claim 35, further comprising an image bearing member.

37. A cartridge according to claim 36, further comprising charging means for charging said image bearing member.

38. A cartridge according to claim 37, further comprising cleaning means for cleaning said image bearing member.

39. A cartridge detachably mountable on an image forming apparatus, comprising:

a developer container for containing a developer; and a memory, wherein said memory stores the number of printed sheets per a weekday and a holiday separately.

40. A cartridge according to claim 39, further comprising an image bearing member.

41. A cartridge according to claim 40, further comprising charging means for charging said image bearing member.

42. A cartridge according to claim 41, further comprising cleaning means for cleaning said image bearing member.

43. An image forming apparatus, comprising:

a photosensitive member;

a light emitting element emitting light that is incident on said photosensitive member in accordance with image information;

developing means for developing a latent image formed on said photosensitive member;

first detecting means for detecting information according to a light emitting time period of said light emitting element;

second detecting means for detecting information according to the amount of developer in said developing means;

calculating means for calculating the number of printable sheets in accordance with the information detected by said first detecting means and the information detected by said second detecting means; and output means for outputting information about the number of printable sheets calculated by said calculating means.

44. An image forming apparatus according to claim 43, wherein, when the remaining amount of the developer is above a predetermined amount, said calculating means calculates the number of printable sheets by placing greater weight on the information detected by said first detecting means than on the information detected by said second detecting means.

45. An image forming apparatus according to claim 43, wherein, when the remaining amount of the developer is below a predetermined amount, said calculating means calculates the number of printable sheets by placing greater weight on the information detected by said second detecting means than on the information detected by said first detecting means.

46. An image forming apparatus comprising:

an image bearing member;

developing means for developing a latent image formed on said image bearing member, said developing means containing a developer;

first detecting means for detecting information according to the remaining amount of the developer;

second detecting means for detecting information according to the remaining amount of the developer, said second detecting means having a higher detecting accurancy when the remaining amount of the developer is below a predetermined amount than said first detecting means;

calculating means for calculating the number of printable sheets in accordance with the information detected by said first detecting means and the information detected by said second detecting means; and output means for outputting information about the number of printable sheets calculated by said calculating means.

* * * * *

UNITED STATES PATENT AND TRADEMARK OFFICE

CERTIFICATE OF CORRECTION

PATENT NO. : 6,343,193 B1
DATED : January 29, 2002
INVENTOR(S) : Hideki Matsumoto et al.

It is certified that error appears in the above-identified patent and that said Letters Patent is hereby corrected as shown below:

Title page,
Item [57], ABSTRACT,
Line 10, “and” should read -- an --.

Column 2,
Line 9, “remained” should read -- remaining --.
Line 28, “invention,” should read -- invention ; and --.

Column 3,
Line 15, “Remained” should read -- Remaining --.

Column 5,
Line 47, “A step S8” should read -- Step S8 --.

Column 7,
Line 46, “advantage” should read -- advantage that --.

Column 8,
Line 2, “remained” should read -- remaining --.

Column 9,
Line 15, “user can,” should read -- user, can --.

Column 10,
Line 8, “is” should read -- are --.

Column 11,
Line 33, “sheet” should read -- sheets --.

Column 12,
Lines 25 and 32, “remained” should read -- remaining --.

UNITED STATES PATENT AND TRADEMARK OFFICE

CERTIFICATE OF CORRECTION

PATENT NO. : 6,343,193 B1
DATED : January 29, 2002
INVENTOR(S) : Hideki Matsumoto et al.

It is certified that error appears in the above-identified patent and that said Letters Patent is hereby corrected as shown below:

Column 14,
Line 43, "one of" should be deleted.

Column 16,
Line 6, "memory" should read -- memory, --.

Signed and Sealed this

Twenty-ninth Day of April, 2003

JAMES E. ROGAN
*Director of the United States Patent and Trademark Office*